US006027203A

United States Patent [19]

Campbell

[11] Patent Number: 6,027,203

[45] Date of Patent: Feb. 22, 2000

[54] PAGE WIDE INK-JET PRINTER AND METHOD OF MAKING

[75] Inventor: Michael Clark Campbell, Lexington, Ky.

[73] Assignee: Lexmark International, Inc., Lexington, Ky.

[21] Appl. No.: 08/988,643

[22] Filed: Dec. 11, 1997

[51] Int. Cl.[7] ..... B41J 2/155; B41J 29/38

[52] U.S. Cl. ..... 347/42; 347/13; 347/14

[58] Field of Search ..... 347/42, 43, 13, 347/14

[56] References Cited

U.S. PATENT DOCUMENTS

| | | | |
|---|---|---|---|
| 5,107,276 | 4/1992 | Kneezel et al. | 347/60 |
| 5,343,227 | 8/1994 | Hirosawa et al. | 347/18 |
| 5,410,340 | 4/1995 | Drake et al. | 347/62 |
| 5,440,332 | 8/1995 | Good | 347/42 |
| 5,469,199 | 11/1995 | Allen et al. | 347/42 |
| 5,625,390 | 4/1997 | Burke et al. | 347/41 |
| 5,742,305 | 4/1998 | Hackleman | 347/42 |
| 5,751,311 | 5/1998 | Drake | 347/43 |

*Primary Examiner*—N. Le
*Assistant Examiner*—Thinh Nguyen
*Attorney, Agent, or Firm*—John A. Brady

[57] ABSTRACT

A page wide printhead for an ink-jet printer includes a plurality of ink-jet nozzles exceeding the number of nozzles used to print across the widest sheet of material to be printed by the printer. The excess nozzles permit the mounting tolerances for printheads to be relaxed so that only selected ones of the nozzles of mounted printheads are within a print site for printing the widest sheet of material to be printed. By selecting those nozzles within the maximum print site for operation of the printer, the sheet wide printheads are effectively mounted with a much higher precision than the relaxed tolerances permit so that ink-jet printers having sheet wide printheads can be economically manufactured. The identification of the nozzles within the maximum print site is performed by printing marks, preferably vertical lines, on a sheet of material and comparing the printed marks to an indicia representing the nominal location for a given picture element (pel). The corresponding mark determines which nozzle should be selected for printing that pel. The difference between the selected nozzle and the nominal location of the given pel determines an offset which can be applied to all of the nozzles of the page wide printhead for printing within the maximum print site. Alternately, a transformation mapping can be assembled for converting nominal pel locations to be printed to actual nozzles of the page wide printhead.

20 Claims, 3 Drawing Sheets

PAGE WIDE INK-JET PRINTER AND METHOD OF MAKING

FIELD OF THE INVENTION

The present invention relates to ink-jet printers and, more particularly, to ink jet printers having one or a plurality of page wide printheads each of which includes a plurality of ink jet nozzles exceeding the number of nozzles used to print the entire width of the widest page to be printed by the printers. A subset of the plurality of nozzles is selected for each page wide printhead to accommodate tolerances which facilitate mounting the page wide printheads into the printers.

BACKGROUND OF THE INVENTION

Printing is commonly performed in an ink-jet printer using a printhead which includes vertical columns of ink-jet nozzles. The printhead is scanned back and forth across a sheet of material to be printed with ink drops being ejected from the nozzles during the scans and the sheet being moved along a sheet path, perpendicular to the scan path, between scans of the printhead. This printhead scanning operation facilitates the adjustment of horizontal dot placement which is needed for printing within different site sizes on different sizes of sheet material. For example, 8½ inch by 11 inch sheet material, usually having a ¼ inch margin on each side of the sheet, is commonly used in the United States. However, other sheet sizes having other margins are also used and are often more common in other countries. A4 sheets, 21.0 cm. by 29.7 cm., are very common throughout the world and use a smaller margin than 8½ inch by 11 inch sheets.

Printing within different site sizes, to accommodate differing margins or for other applications, is easily performed using a scanning printhead. The printhead simply deposits ink as it passes over the required printing locations of the sheets. Scanning printheads also simplify the alignment of black ink and color inks when black and color inks are ejected from two different sets of nozzles which are not necessarily consistently mechanically aligned with respect to one another. Thus, the black nozzles can be activated when they are over the appropriate sheet locations and the color nozzles can be activated when they are over appropriate sheet locations once the actual mechanical alignment between the black and color nozzles is determined and used to control the nozzles.

To increase the throughput of an ink-jet printer, page wide print arrays have been used. Such print arrays require substantially more nozzles than commonly used scanning printheads. For example, an 8 inch wide 300 dpi ink-jet printer requires 2400 nozzles for printing black (k). For color printing, separate print arrays are required for each of the colors, i.e., cyan (c), magenta (m) and yellow (y). Problems regarding the construction of page wide print arrays have been addressed in the prior art. See, for example, U.S. Pat. No. 5,440,332 and U.S. Pat. No. 5,469,199 which disclose page wide printhead structures.

In ink-jet printers having one or more page wide printheads, the printhead or printheads must be fixed within a printer with respect to the path which the print medium follows. This raises a problem with regard to precision placement of one or more page wide printheads within an ink-jet printer. Clearly, precision placement of printheads within printers can be accomplished; however, such precision placement adds substantially to the time and cost of manufacturing so that printers requiring precision page wide printhead placement are not commercially viable.

It is desired to reduce the cost of manufacturing ink-jet printers including page wide printheads by eliminating the need for precision placement of the page wide printheads within printers. Preferably, new ink-jet printers using one or more page wide printheads and methods of making the printers would require little, if any, additional hardware for eliminating the precision placement of the page wide printheads and, more preferably, would require no hardware but utilize available software capacity of the printers.

SUMMARY OF THE INVENTION

The instant invention is directed to ink-jet printers including one or more page wide printheads with each printhead having a plurality of ink-jet nozzles exceeding the number of nozzles used to print across the entire page width of the widest sheet of material to be printed by the printer and methods of making such ink-jet printers. Due to the excess number of nozzles, the mounting tolerances for the printheads within the printer can be relaxed. When the printheads are mounted using the relaxed tolerances, only certain ones of the nozzles are within a maximum print site for printing the widest sheet of material to be printed. By selecting those nozzles within the maximum print site for operation of the printer, the sheet wide printheads are effectively mounted within a much higher precision than the relaxed tolerances permit so that ink-jet printers having sheet wide printheads can be economically manufactured. The identification of the nozzles within the maximum print site may be performed by printing marks, preferably vertical lines, on a sheet of material and comparing the printed marks to an indicia representing the nominal location for a given picture element (pel). The corresponding mark determines which nozzle should be selected for printing that pel. The difference between the selected nozzle and the nominal location of the given pel determines an offset which can be applied to all of the nozzles of the page wide printhead for printing within the maximum print site. Alternately, a transformation mapping can be assembled for converting nominal pel locations to be printed to actual nozzles of the page wide printhead.

DETAILED DESCRIPTION OF THE PREFERRED EMBODIMENT

Figure 1:
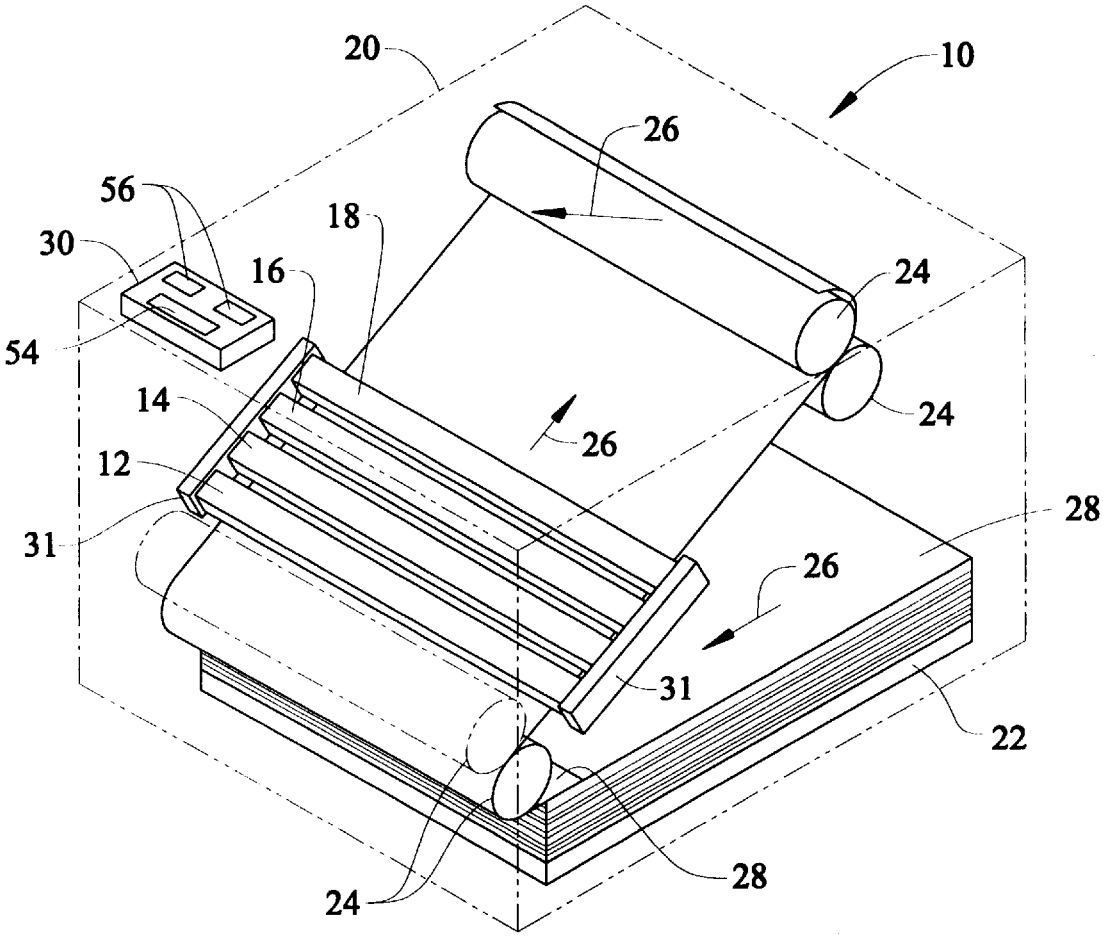
FIG. 1 is a schematic perspective view of an ink-jet printer of the present invention having a plurality of page wide printheads.

Reference will now be made to the drawing figures wherein FIG. 1 illustrates, in schematic perspective view, an ink-jet printer 10 of the present invention having a plurality of printheads, preferably page wide printheads. In particular, the printer 10 includes four page wide printheads: a black—k printhead 12; a cyan—c printhead 14; a magenta—m printhead 16; and, a yellow—y printhead 18. The printer 10 includes a housing 20 which, through a paper tray 22, platens 24 and other well known apparatus (not shown), defines a sheet path 26 through the printer 10. Sheets of material, such as paper 28, to be printed upon are moved along the sheet path 26 by any of a number of well known paper handling techniques. Since paper handling and associated apparatus within the printer 10 form no part of the present invention, they will not be described in detail herein.

The page wide printheads 12–18 are mounted within the printer housing 20 adjacent a portion of the sheet path 26 for depositing ink drops on sheets of material moving along the sheet path 26. Each of the printheads 12–18 have a plurality of ink-jet nozzles n, see FIG. 3 and FIG. 2 wherein the nozzles n are represented schematically by a series of *'s. The number of nozzles in each of the printheads 12–18 exceeds the number of nozzles used to print across the entirety of a sheet of material having the widest width accommodated by the printer 10. For example, in a 300 dots-per-inch (dpi) printer 10, for a page wide printhead to print upon eight inches of a sheet of material, 2400 nozzles are required. Accordingly, if the printer 10 is to print an eight inch width on sheets of material passing through the printer, each of the printheads 12–18 has more than 2400 nozzles. It is noted, however, that while the printheads 12–18 have more nozzles than required, the printheads 12–18 do not have to have the same number of nozzles.

A controller 30 selects which of the ink-jet nozzles n are used for operation of the printer 10 with the selected ink-jet nozzles n depending upon the mounting of the printheads 12–18 within the printer 10. By selecting the nozzles of the page wide printheads 12–18 which are used to print the entirety of the widest sheet of material to be printed, the printheads can be mounted within the printer housing 20 with reduced precision. The reduced mounting precision enables reduced tolerances for the printheads 12–18 and mountings 31 within the printer housing 20 thereby reducing manufacturing time and costs.

Figure 2:
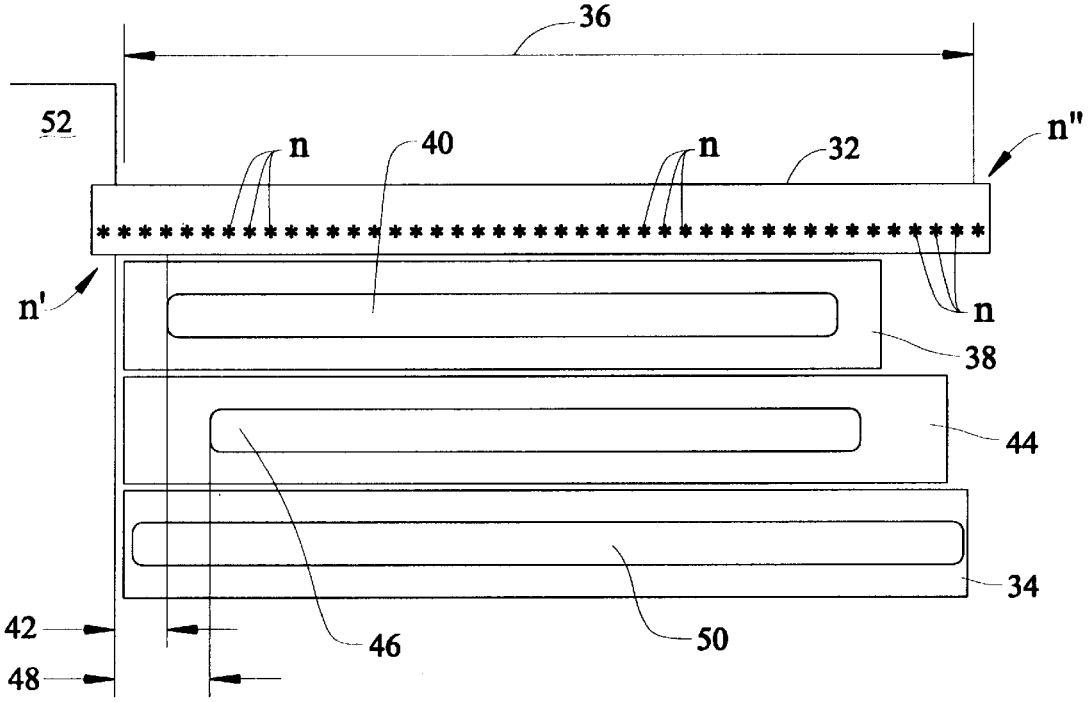
FIG. 2 is a schematic illustration of a page wide printhead shown relative to three different sizes of sheet material to be printed upon by the printhead.

Before describing the selection of which nozzles of the page wide printheads 12–18 are used for printing, the general concept of nozzle selection within a page wide printhead will be described with reference to FIG. 2. In FIG. 2, a page wide printhead 32 is illustrated as having nozzles n, schematically illustrated by *'s, which exceed the number of nozzles used to print upon the widest sheet of material 34 passing through the printer. The nozzles used to print are within a range of nozzles indicate by the arrow 36. It is apparent that, as illustrated, excess nozzles n' extend beyond the left side of the sheet of material 34 and excess nozzles n" extend beyond the right side of the sheet of material 34. In accordance with the present invention, the minimum number of excess nozzles $n'+n\Delta$ corresponds to the mounting tolerances of the printheads 12–18 within the printer 10. That is, if the mounting tolerance for a printhead can vary the position of a nozzle of the printhead by ±x nozzles, then the printheads can have as few as 2×excess nozzles. Of course, more than 2×nozzles can be provided if it facilitates economical production of the printheads.

As shown in FIG. 2, a sheet 38 of A4 paper (21.0 cm. by 29.7 cm.) having a print area 40 of eight inches has a margin 42 of around 0.13 inches or around 40 pels at 300 dpi while an 8½ inch by 11 inch or letter size sheet of paper 44 having a print area 46 of eight inches has a margin 48 of around 0.25 inches or around 75 pels at 300 dpi. The final sheet of paper in FIG. 2, the sheet of material 34, is illustrated as having a print area 50 being printed entirely from its left edge to its right edge. The sheet of material 34 can be for telefax or other appropriate use. While telefax paper is usually a common paper size, it is illustrated as being wider than A4 or letter size paper sheets to illustrate the versatility of the present invention.

Prior to the current invention, a problem with page wide printheads is that they have had to be very precisely mounted within a printer so that predefined nozzles of the printheads are aligned with locations on the area to be printed. Thus, a conventional printhead mounted in the place of the printhead 32 would have had to be mounted so that its 40th nozzle was precisely aligned at 0.13 inches from a fixed paper guide 52 and its 75th nozzle would also be precisely aligned at 0.25 inches from the paper guide 52. Such precision mounting adds expense to an ink-jet printer including the printhead.

The printheads 12–18 of the present invention are fixedly installed within the printer housing 20 with a relaxed precision such that the 40th nozzles of the printheads may not be and probably are not aligned at 0.13 inches from the paper guide 52 and the 75th nozzles may not be and probably are not aligned at 0.25 inches from the paper guide 52. Moreover, the printheads 12–18 can be installed individually so that they may not be and probably are not in alignment with one another. However, in accordance with the present invention, by providing nozzles in excess of the number needed for printing the widest sheet of material to be printed, some nozzles are not used and only those nozzles corresponding to an area to be printed for the printer 10 are selected for use by the controller 30.

Figure 3:
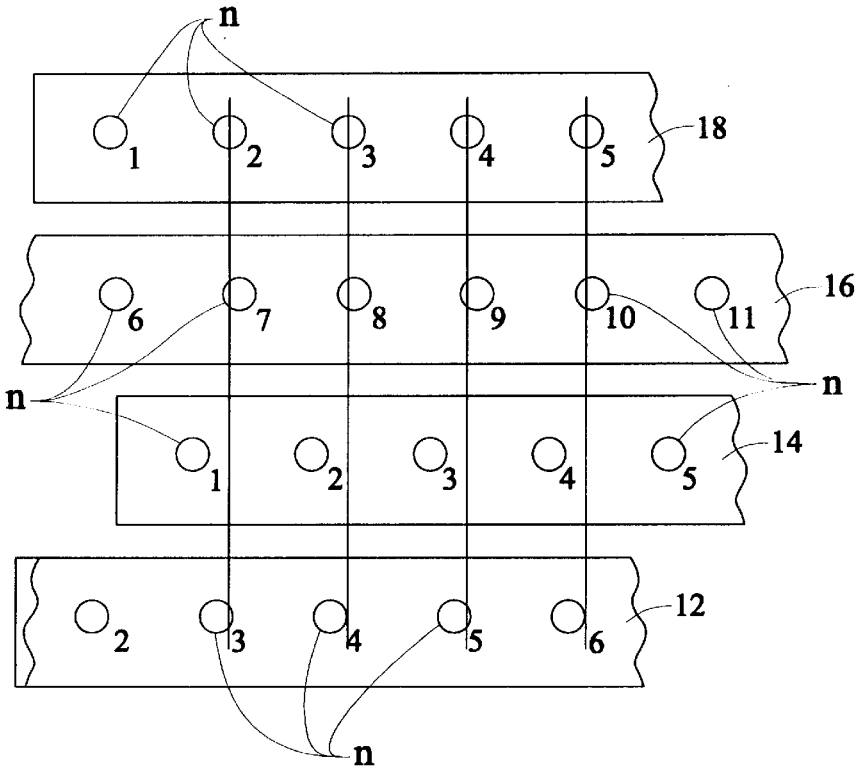
FIG. 3 illustrates electronic alignment of four page wide printheads (black—k, cyan—c, magenta—m, and yellow—y) using the invention of the present application.

An example of the nozzle selections for a color ink-jet printer having four page wide printheads 12, 14, 16, 18 (k, c, m, y) is illustrated in FIG. 3. The selection of nozzles by the controller 30 shown in FIG. 3 is to assign a given one of the nozzles in each printhead as the first nozzle in the range of nozzles from 1 to Z where Z equals the number of inches to be printed multiplied by the number of dots per inch (dpi) or pels per inch. Accordingly, nozzle #3 is assigned as the first nozzle in the k printhead 12; nozzle #1 is assigned as the first nozzle in the c printhead 14; nozzle #7 is assigned as the first nozzle in the m printhead 16; and, nozzle #2 is assigned as the first nozzle in the y printhead 18. Thus, there is an offset of 2 for the k printhead 12; and offset of 0 for the c printhead 14; and offset of 6 for the m printhead 16 and an offset of 1 from the y printhead 18.

The controller 30 then applies the offsets to identify ones of the nozzles in the printheads 12–18 which correspond to nominal ink-jet nozzles and the identified or offset nozzles are used for printing. The controller 30 can also determine a range of nozzles which are mapped so that the appropriate ones of the nozzles are used for printing. The controller 30 includes storage into which the offsets or ranges are loaded for operation of the printer 10. The storage can be nonvolatile random access memory 54 or switches 56 can be manually set to define the offsets or ranges of nozzles to be used.

Determination of the offsets or ranges for the page wide printheads 12–18 can be performed in the present invention by determining positions of drops deposited by individual nozzles of the printheads 12–18 on a printable area of the printer 10. The nozzle offsets or ranges of nozzles which define the portions of the printheads 12–18 which are to be used for printing are then selected based on determined drop positions. In particular, individual nozzles are operated to print marks around a location across the printable area. For example, the margin location for A4 paper may be selected as the location or target area. The marks made by the individual nozzles are then compared to an indicia of the location so that appropriate ones of the nozzles of each of the printheads 12–18 can be selected for printing that location.

Figure 4:
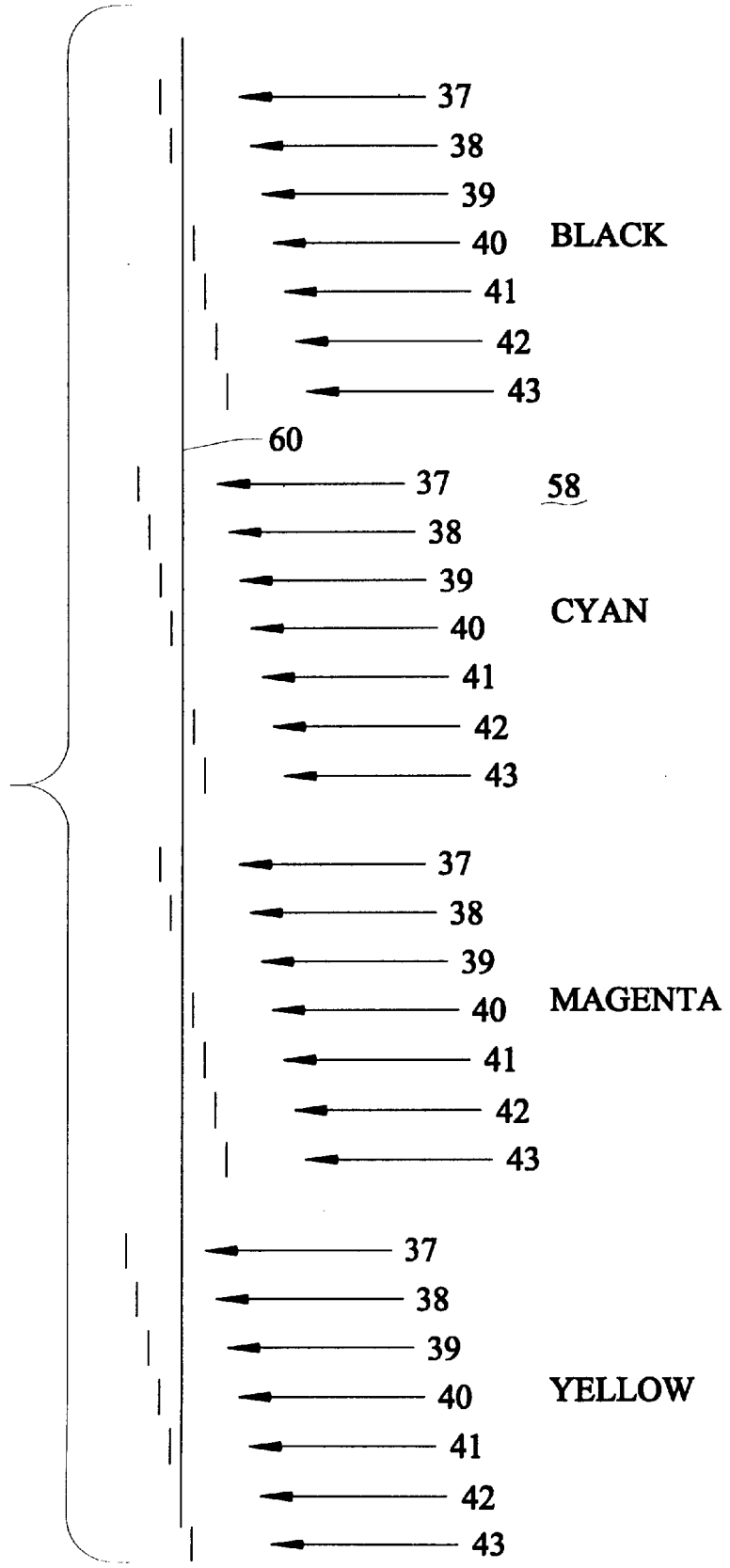
FIG. 4 illustrates a procedure of the present invention for alignment of four page wide printheads of an ink-jet printer.

As illustrated in FIG. 4, the target area or location selected is the nominal margin location for A4 paper, i.e. the 40th nominal nozzle. In the illustration of FIG. 4, a printhead mounting tolerance of 3 nozzle locations is shown although any reasonable and acceptable printing mounting tolerance can be selected to facilitate ease of production of the printer. In any event, the 40th nozzle and the three nozzles on either side of the 40th nozzle, i.e. nozzles 37–43, are operated to make corresponding marks on a reference sheet of material 58. The marks are shown on an exaggerated scale for ease of illustration; however, the marks are readily discernible one from another. The corresponding nozzle numbers are preferably printed out either in the corresponding printhead color or in black, which is preferred to facilitate accurate identification of the nozzle marks.

The marks printed by the individual nozzles 37–43 are then compared to an indicia 60 of the 40th nominal nozzle so that the closest one of the printed marks can be selected as the nozzle to be used as the 40th nozzle for printing by the printheads. Thus, for the black k printhead 12, the 39th nozzle (offset −1) is selected as the 40th nozzle; for the cyan c printhead 14, the 41st nozzle (offset +1) is selected as the 40th nozzle; for the magenta m printhead 16, the 39th nozzles (offset −1) is selected for the 40th nozzle; and, for the yellow y printhead 18, the 42nd nozzle (offset +2) is selected as the 40th nozzle. Appropriate ranges are determined by adding the offsets to the nominal ranges.

The indicia 60 can be printed on the sheets upon which the marks are printed or can be provided on a transparent template which can be aligned with a printed sheet for determination of the offsets/ranges of nozzles to be used. As illustrated and currently preferred, the marks printed by the nozzles are vertical lines as is the indicia; however, other forms of marks can be used in the present invention. Also, other locations on the printable area can be used to determine which ones of the nozzles of the printheads 12–18 are to be used for printing.

Having thus described the invention of the present application in detail and by reference to preferred embodiments thereof, it will be apparent that modifications and variations are possible without departing from the scope of the invention defined in the appended claims.

What is claimed is:

1. An ink-jet printer comprising:

a printer housing defining a path for sheets of material to be printed;

a printhead mounted across said path within said printer housing adjacent said path, said printhead having a plurality of ink-jet nozzles exceeding a number of nozzles used to print across the entirety of sheets having the widest width accommodated by said printer and extending across said path a width wider than said widest width accommodated by said printer; and a controller selecting which of said ink-jet nozzles are to be used for operation of said printer wherein selected ink-jet nozzles are those of said nozzles located in said path within said widest width accommodated by said printer.

2. An ink-jet printer as claimed in claim 1 wherein said printhead comprises a page wide printhead.

3. An ink-jet printer as claimed in claim 1 wherein said controller includes storage defining a nozzle offset and determines said selected ink-jet nozzles by applying said nozzle offset to nominal ink-jet nozzle locations.

4. An ink-jet printer as claimed in claim 3 wherein said storage comprises nonvolatile random access memory.

5. An ink-jet printer as claimed in claim 3 wherein said storage comprises switches.

6. An ink-jet printer as claimed in claim 1 wherein said controller includes storage defining a range of ink-jet nozzles to be used for printing by said printer.

7. An ink-jet printer as claimed in claim 6 wherein said storage comprises nonvolatile random access memory.

8. An ink-jet printer as claimed in claim 6 wherein said storage comprises switches.

9. An ink-jet printer comprising:

a printer housing defining a path for sheets of material to be printed; and a printhead mounted across said path within said printer adjacent said path, said printhead having a plurality of ink-jet nozzles exceeding a nominal number of nozzles used to print across the entirety of sheets having the widest width accommodated by said printer, said number exceeding being at least a number of nozzles corresponding to mounting tolerances for said printhead within said printer.

10. An ink-jet printer as claimed in claim 9 wherein said printhead comprises a page wide printhead.

11. An ink-jet printer as claimed in claim 9 further comprising a controller selecting which of said ink-jet nozzles are to be used for operation of said printer.

12. An ink-jet printer comprising:

a printer housing defining a path for sheets of material to be printed;

a plurality of printheads mounted across said path within said printer housing adjacent said path, each of said printheads having a plurality of ink-jet nozzles exceeding a number of nozzles used to print across the entirety of sheets having the widest width accommodated by said printer and extending across said path a width wider than said widest width accommodated by said printer; and a controller selecting which of said ink-jet nozzles of each of said plurality of printheads are to be used for operation of said printer wherein selected ink-jet nozzles of each of said plurality of printheads are those of said nozzles located within said widest width accommodated by said printer.

13. An ink-jet printer as claimed in claim 12 wherein said controller includes storage defining a nozzle offset for each of said plurality of printheads and determines said selected ink-jet nozzles by applying said nozzle offsets to nominal ink-jet nozzle locations.

14. An ink-jet printer as claimed in claim 13 wherein said storage comprises nonvolatile random access memory.

15. An ink-jet printer as claimed in claim 13 wherein said storage comprises switches.

16. An ink-jet printer as claimed in claim 12 wherein said controller includes storage defining a range of ink-jet nozzles for each of said plurality of printheads to be used for printing by said printer.

17. An ink-jet printer as claimed in claim 16 wherein said storage comprises nonvolatile random access memory.

18. An ink-jet printer as claimed in claim 17 wherein said storage comprises switches.

19. An ink-jet printer comprising:

a printer housing defining a path for sheets of material to be printed; and a plurality of printheads mounted across said path within said printer adjacent said path, said plurality of printheads each having a plurality of ink-jet nozzles exceeding a nominal number of nozzles used to print across the entirety of sheets having the widest width accommodated by said printer, said number exceeding being at least a number of nozzles corresponding to mounting tolerances for said printhead within said printer.

20. An ink-jet printer as claimed in claim 19 further comprising a controller selecting which of said ink-jet nozzles for each of said plurality of printheads are to be used for operation of said printer.

* * * * *